US005857627A

United States Patent [19]

Horwell et al.

[11] Patent Number: 5,857,627

[45] Date of Patent: Jan. 12, 1999

[54] FOAM-FORMING NOZZLE

[76] Inventors: Simon Howard Horwell, 45 Onslow Gardens, Sanderstead, South Croydon, Surrey CR2 9AF, England; Philip H. Brice, 75 Purneys Road, Eltham, London SE9 6HU, England

[21] Appl. No.: 546,113

[22] Filed: Oct. 20, 1995

[30] Foreign Application Priority Data

Oct. 24, 1994 [GB] United Kingdom ..... 9421382

[51] Int. Cl.[6] ..... E03C 1/08

[52] U.S. Cl. ..... 239/428.5; 239/432; 239/462; 169/14

[58] Field of Search ..... 239/318, 398, 239/407, 427, 428.5, 432, 434, 439, 461, 462, 456–8, 499, 507, 514; 169/14, 15

[56] References Cited

U.S. PATENT DOCUMENTS

| | | | |
|---|---|---|---|
| 2,524,421 | 10/1950 | Boerner et al. | 169/15 |
| 2,998,930 | 9/1961 | Aghnides | 239/428.5 |
| 3,134,825 | 5/1964 | Sexton | 239/434 |
| 3,388,868 | 6/1968 | Watson et al. | 239/428.5 |
| 3,424,250 | 1/1969 | Thomae | 169/15 |
| 3,633,824 | 1/1972 | Aghnides | 239/428.5 |
| 4,219,159 | 8/1980 | Wesner | 239/428.5 |
| 4,322,292 | 3/1982 | Knox | 239/428.5 |
| 4,330,086 | 5/1982 | Nysted | 239/8 |
| 4,646,973 | 3/1987 | Focaracci | 239/428.5 |
| 4,805,700 | 2/1989 | Hoover | 169/15 |
| 4,815,665 | 3/1989 | Haruch | 239/434 |
| 4,830,790 | 5/1989 | Stevenson | 261/18.1 |
| 4,925,109 | 5/1990 | Flanagan et al. | 239/432 |
| 5,054,688 | 10/1991 | Grindley | 239/407 |
| 5,058,809 | 10/1991 | Carroll et al. | 239/428.5 |
| 5,085,371 | 2/1992 | Paige | 239/428.5 |
| 5,165,606 | 11/1992 | Pelet | 239/427.3 |
| 5,397,060 | 3/1995 | Maas et al. | 239/333 |

FOREIGN PATENT DOCUMENTS

| | | |
|---|---|---|
| 0119527 | 3/1984 | European Pat. Off. . |
| 0424995 | 5/1934 | United Kingdom . |
| 0920941 | 7/1958 | United Kingdom . |
| 1394140 | 5/1973 | United Kingdom . |

*Primary Examiner*—Andres Kashnikow
*Assistant Examiner*—Lisa Ann Douglas
*Attorney, Agent, or Firm*—Patterson & Keough, P.A.

[57] ABSTRACT

A nozzle arrangement for a medium expansion foam fire extinguisher. The nozzle arrangement comprises a discharge tube with a discharge port for the foam at one end. At the other end there is a full cone supply nozzle for the foam concentrate solution. The tube has air inlets in line with the outlet from the spray nozzle. A mesh screen is located between the supply nozzle and the discharge outlet.

5 Claims, 3 Drawing Sheets

FOAM-FORMING NOZZLE

FIELD OF THE INVENTION

The present invention relates to a device for the formation of a foam from a water based solution of a foam-forming liquid concentrate from a hand-held portable tank. In particular, the foam is a medium expansion foam, for example, for use in fire suppression and chemical spill control.

BACKGROUND OF THE INVENTION

The term "foam expansion" is well understood in the art. A low-expansion type foam is one which has a liquid to foam ratio of less than 1:20 (<1:20); a medium-expansion type foam has a ratio of from 1:20 to 1:250 and a high-expansion type foam has a ratio greater than 1:250(>1:250), ideally not exceeding 1:1000.

Modern safety standards in the industrial environment and the increasing and ever more complex fire risks have necessitated the installation of fire fighting equipment. This would typically consist of fire blankets and fire extinguishers, of for example, water, foam, carbon dioxide, halon and powder types.

Portable fire extinguishers are required in all sectors of industry but are particularly vital in high risk areas such as chemical installation, laboratories, petrol stations, power stations, kitchens, oil rigs etc. The usefulness of the present invention can be seen by considering deep fat fires in kitchens, especially of fast food outlets where the easy and safe extinguishing of those fires is rather difficult to achieve using conventional extinguishers.

Carbon dioxide can be effective on many fires, but for use on burning fat or cooking oil it has the disadvantage that although it extinguishes the flames, it does not cool the fat or oil sufficiently to bring it below its auto-ignition point. Hence, when the carbon dioxide discharge is stopped, re-ignition of the fat or oil is inevitable.

Dry powders are also effective on many fires, including fats and oils, but it has the disadvantage that it is very messy, does not cool sufficiently and evolves acrid fumes in many cases. The discharges from powder extinguishers are also very powerful and can splash the hot fat or oil onto the surroundings.

Halon 1211 (Bromochlorodifluoromethane—BCF) extinguishers are not effective on deep fat fires and their use on such fires tends to produce a cocktail of toxic gases. Also, Halons pose a serious threat to the ozone layer and their use is diminishing.

Water in any form from an extinguisher is not suitable for use on deep fat fires.

Previously known portable foam extinguishers have used only low-expansion foams or have been of the non-aspirated spray type. Although both forms of foam extinguishers are well established and are effective when used by skilled operators, there are several problems associated with their use.

Low-expansion foams used in presently available types of fire extinguishers are actually relatively "wet" as the ratio of air to water is not particularly high. When used in fighting fires these foams can cause significant water damage. Another consequence of the water content of the low-expansion foam is the risk, for example, in fighting a deep fat fire in a kitchen, of causing the fat to spit or erupt and boil over violently before the fire is extinguished. This is a significant hazard to the operator of the fire extinguisher and can also cause the fire to spread.

Potential operators of low-expansion foam fire extinguishers require special training and practice to ensure safe and effective use of the apparatus. Even skilled operators may cause damage to fragile equipment due to the high velocity of the discharge from the extinguishers. If the low-expansion foam is applied incorrectly to a flammable liquid fire, the foam may be driven under the surface of the burning liquid and rendered ineffective.

Foam is perhaps the best agent currently available for deep-fat fires in kitchens. However, it is seldom selected due to the disadvantages described above. In particular, the fact that incorrect application can cause boil-over and fire-ball effects leading to the fire spreading and to injuring the operator, has mitigated against the wider use of foam fire extinguishers in industrial cooking areas.

Medium expansion type foams are well known in the art for extinguishing fires involving flammable liquids and are of particular use in fighting fires in confined areas such as cellars and engine rooms on ships etc. They can also be used to secure spills of flammable liquids and to suppress fume release from toxic spills etc. Although they are often used on a large scale by fire brigades, ship fire crews, petrochemical plants etc, it has not previously been possible to use these foams on smaller fires due to the bulky nature of the foam generating equipment and their high delivery rates. The most common medium expansion foam generator in current use, often referred to as a "foam branch pipe", requires a foam compound solution supply rate of 450 liters/min at 4 bar ($4\times10^5$Pa) pressure. This device will deliver on average 7,000 gallons of foam per minute (26.5$m^3$/min).

SUMMARY OF THE INVENTION

It is an object of the present invention to provide a hand-held portable fire extinguisher which will produce medium expansion foam of good quality and which can be operated by persons who have little or no training.

According to the invention, there is provided a foam-forming nozzle arrangement comprising: a casing having a foam discharge port at one end; a foam concentrate solution supply nozzle within the casing; at least one air inlet into the casing; and a mesh screen, within the casing between the supply nozzle and the discharge part; the air inlets being located along the casing at a position generally in line with the outlet from the supply nozzle.

It is believed that the location of the air inlet or inlets in line with the outlet from the supply nozzle causes the most efficient induction of air by means of a Venturi effect created by the kinetic energy and velocity of the spiralling cone spray. This is clearly an advantage since the device according to the invention requires no moving parts, which are sometimes seen in larger medium expansion foam nozzles.

Preferably the supply nozzle is a full cone nozzle. Simple full cone spray nozzles producing medium to coarse atomization are suitable, reducing cost and increasing reliability. This helps to enable the apparatus to work over a wide range of foam concentrate solution pressures. The supply nozzle may produce a 30° or a 90° cone, though any value from 15° to 120° may be used. It has been found that values above 120° compromise air induction due to violation of Venturi-screen space with reduced droplet velocity.

Preferably the mesh screen is located at a position in the casing upstream of the position where the foam-concentrate solution spray cone envelope intersects the sides of the casing, in use. The mesh screen may be a single screen, preferably flat and fine meshed, or a double screen, preferably coarse meshed. The double screen preferably comprises a flat screen and a conical screen, downstream of the flat screen, though in fact, the screen arrangement may comprise any combination of single and double, flat and conical screens.

The screens may have any parameters between 10 mesh ×15 swg to 60 mesh ×50 swg (0.81×1.83 mm to 0.18 ×0.25 mm). Fine mesh can be considered from 60 mesh ×50 swg to 40 mesh ×30 swg (0.18×0.25 mm to 0.25×0.315 mm). Coarse mesh can be considered from 40 mesh ×30 swg to 10 mesh ×15 swg (0.25×0.315 mm to 0.81×1.83 mm).

The discharge port may have a diameter in the range of from 1 cm to 150 cm. Preferably 1 to 12 cm, more preferably 2 to 6cm. The discharge port may have a blabber mouth or other deflecting plate(s). The preferred diameter range for the tube is 1 to 2 inches or 25 to 51 mm.

The air inlets are preferably as large as is practical without compromising the structural integrity of the housing. The spray nozzle is then positioned generally in the middle of the air intake zone or slightly in front.

It is an object of the present invention to provide a portable medium expansion foam delivery device, with a suitable nozzle arrangement, which can be easily operated without training and with a minimum of danger.

It is a further object of the invention that the device should be usable by one person.

The invention also extends to a foam delivery device employing a nozzle arrangement as described. Such a delivery device preferably also includes a reservoir or tank for a supply of foam solution, means for discharging the foam solution from the reservoir and a valve arrangement for controlling the discharge preferably not exceeding 23 kilos gross. Preferably, the reservoir is under pressure. The pressure may be in the range of from 3 to 20 bar (0.3 to 2.0 MPa), preferably 10 to 16 bar (1.0 to 1.6 MPa). Alternatively discharge may be effected by a gas cartridge pressure charge arranged to pressurize the reservoir prior to discharge, the gas cartridge preferably being actuated by the discharge valve mechanism.

Preferably, the tank has a capacity of from 1 to 15 1, more preferably 5 to 10 l. The delivery rate may be 5 to 60 liters per minute at approximately 6 bar (0.6 MPa), although pressures may range from 5 to 20 bar (0.5 to 2.0 MPa) with 6 to 16 bar (0.6 to 1.6 MPa) being nominal.

The delivery device is capable of producing a foam expansion ration of from 1:20 to 1:250, or higher. Generally, the ratio should be at least 1:30 and would not normally exceed 1:100. A preferred range would be from 1:40 to 1:60, with 1:50 being about optimum.

In one preferred embodiment, the pressure of the foam concentrate solution is in the range of 8 to 12 bar (0.8 to 1.2 MPa), more preferably 9 to 11 bar (0.9 to 1.1 MPa), the supply nozzle is a 90° full cone nozzle, the screen is a single fine mesh screen, and the discharge port has a diameter of 2 to 3 cm.

In an alternative preferred embodiment, the pressure of the foam concentrate solution is in the range of 4 to 12, 16 or even 20 bar (0.4 to 1.2, 1.6 or 2.0 MPa), the supply nozzle is a 30° full cone nozzle, the screen comprises a flat screen and a coarse mesh conical screen, with or without a preceding flat screen and the discharge port has a diameter of 3.5 to 4 cm.

The invention therefore renders possible a medium expansion foam portable fire extinguisher which can be used safely and easily by non-skilled operators. The term "non-skilled" operator may be defined as a person who has little or no experience in first-aid fire fighting, and/or a person who is unable to achieve at least 80% of a design fire rating on an extinguisher under test conditions unaided.

DESCRIPTION OF THE PREFERRED EMBODIMENTS

Figure 1:
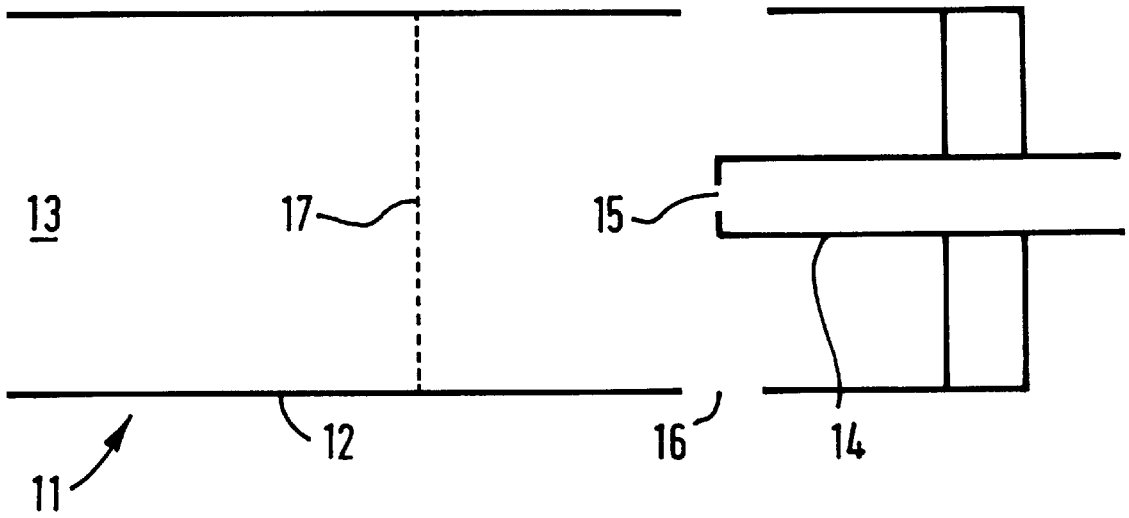
FIG. 1 is a schematic representation of a first embodiment of nozzle arrangement.

FIG. 1, shows a nozzle arrangement 11 for a medium expansion foam fire extinguisher (not shown). The nozzle arrangement comprises a discharge tube or casing 12 with a discharge port 13 for the foam at one end. At the other end, which is closed, there is a supply nozzle 14 for the foam concentrate solution, which has an outlet 15. There are air inlets or intakes 16 in the tube 12 at a position along its length which is in line with the outlet 15 from the supply nozzle 14. A flat screen 17 is located within the tube 12 between the supply nozzle 14 and the outlet port 13.

The tube is generally cylindrical (though conical tubes would be possible) and has a diameter of 1 inch (2.54 cm). The port 13 which is of the same diameter may have a blabber mouth or deflector plate (not shown). The nozzle 14 is a 90° full cone nozzle. The air intakes 16 are arranged circumferentially about the tube 12 and in the illustrated embodiment are 8 in number. Their dimensions can be varied in order to obtain the ideal balance between structural integrity and optimum air induction.

The mesh screen 17 is a fine mesh screen whose parameters are 30 mesh ×34 swg (0.623 mm × 0.224 mm APER), though naturally, deviations from those figures would be envisaged depending on the prevailing and required conditions. The screen 17 is located within the tube 12 at such a position that the cone of liquid from the nozzle 14 impinges upon it before it would have impinged upon the tube 12.

Figure 2:
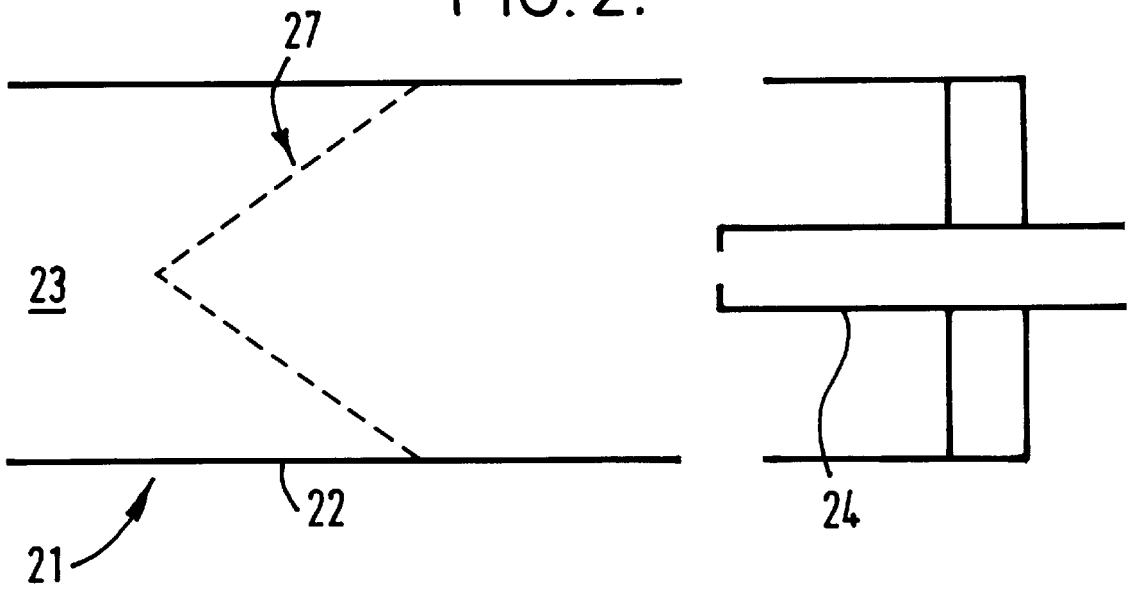
FIG. 2 is a similar view of a second embodiment.

The nozzle arrangement 21 of FIG. 2 is generally similar to that of FIG. 1. However, the tube 22 and port 23 have a diameter of 1½ inches (3.8 cm). The supply nozzle 24 is a 30° full cone nozzle and the screen 27 is conical. The mesh parameters are 40 mesh ×34 swg (0.411×0.224mm APER) though other sizes can be used. Similarly, combinations of both flat and conical screens may be used. Whereas the earlier embodiment would tend to operate at a foam solution pressure of about 10 bar (1MPa) the second embodiment could operate in the range of 4 to 14 bar (0.4 to 1.4 MPa) particularly if two screens were used. In other respects the two embodiments are similar.

In operation, the two embodiments are also similar. Foam compound solution is stored under pressure in an extinguisher body (not shown) or, a pressure cartridge is provided which is designed to release its content into the extinguisher body upon actuation (not shown), thus rendering the extinguisher content under pressure. This pressure depends upon the type of foam nozzle, its application and the type of foam compound being used.

When operated, the foam concentrate solution is supplied to the supply nozzle 14 which produces a full cone spray of medium to coarse atomization at good velocity. This spray is discharged into the tube 12 equipped with air intake ports 16, from the supply nozzle 14. The spray discharge point 15 is located in the region of the air intakes 16. This results in a Venturi effect which causes an internal pressure drop and air is inducted into the spray area.

The droplets of foam solution are then played onto the mesh 17 where they settle due to the surface tension. The inducted air flow then distends the droplets on the mesh 17 to form bubbles. The process occurs repeatedly thousands of times a second.

The type of foams produced is dependent on a number of factors. Most common aqueous film forming foam compounds (AFFF) are not suitable for generating medium expansion foams for most purposes due to the very high drainage rate of these foams and their exceptionally low surface tensions. However, an AFFF 1% compound produced by '3M' UK Ltd, is capable of producing good foams when used with the nozzles of this invention, though it may be necessary to adjust usage concentrations.

Fluoroprotein foam compounds based on proteins and fluorinated surfactants are difficult to foam in medium expansion generators and in order to produce good quality foams, the inlet pressures have to be low or the nozzle fitted with two screens. Protein foams based on keratin hydrosylates and detergent blends produce reasonable foams with moderate drainage rates.

Synthetic foam compounds based on the salts of alkyl ether sulphates produce high quality foams with low drainage rates and at maximum available expansion rates, however their fire fighting performance tends to be poor.

The gauge of wire which constructs the mesh 17, and the orifice size of the mesh 17, are the main factors which determine the quality of finished foam produced.

Protein foams require two screens and slightly higher operating pressures of up to 200 psi (1.4 MPa). In general, mesh screens with large orifice sizes produce good expansion rates with a large means bubble size. Smaller sizes produce more tenacious foams of smaller bubble size and usually a slightly decreased expansion rate.

The size of mesh used is a choice mainly influenced by the required type of foam discharge.

The following test results show foam generation characteristics under various conditions. The tests were carried out using a nozzle constructed as shown in FIG. 1.

The nozzle parameters were:

1 inch diameter tube (2.54 cm)

90° full cone spray nozzle

Flat screen—single—30 mesh ×34 swg—0.623 APR

54% open surface area

Test 1

To determine the relationship between foam concentrate solution supply pressure and expansion rate.

Method:

A tank of foam concentrate solution composed of 2% by volume synthetic compound balance water was pressurized to the required pressure with nitrogen. The foam was then discharged into a 5 liter collection container until overflowing. The discharge was then stopped and the excess foam head skimmed off the top of the container. The foam in the container was then sprayed with exactly 5 $cm^3$ of a solution of 10% RD Emulsion Polysiloxane anti-foam and the foam allowed to degenerate. Then the drainage liquid was poured into a measuring cylinder and a reading taken. The addition of the polysiloxane accelerates the foam degeneration, however, its presence must be taken into account in the final calculation.

Results

The expansion rates were calculated by the following formula:

$$\frac{FV}{Dv - AFv} = \text{EXP}$$

Where:

Fv=Foam volume

Dv=Drainage liquid volume

AFv=Anti-foam volume

EXP=Expansion

| Results | | | | | | |
|---|---|---|---|---|---|---|
| PSI | 150 | 125 | 100 | 75 | 50 | 25 |
| (MPa) | (1) | (0.83) | (0.67) | (0.5) | (0.33) | (0.17) |
| Expansion | 23 | 23 | 43 | 56 | 57 | 29 |

(foam expansion rates over a ratio of 20:1 qualify as medium expansion)

Figure 3:
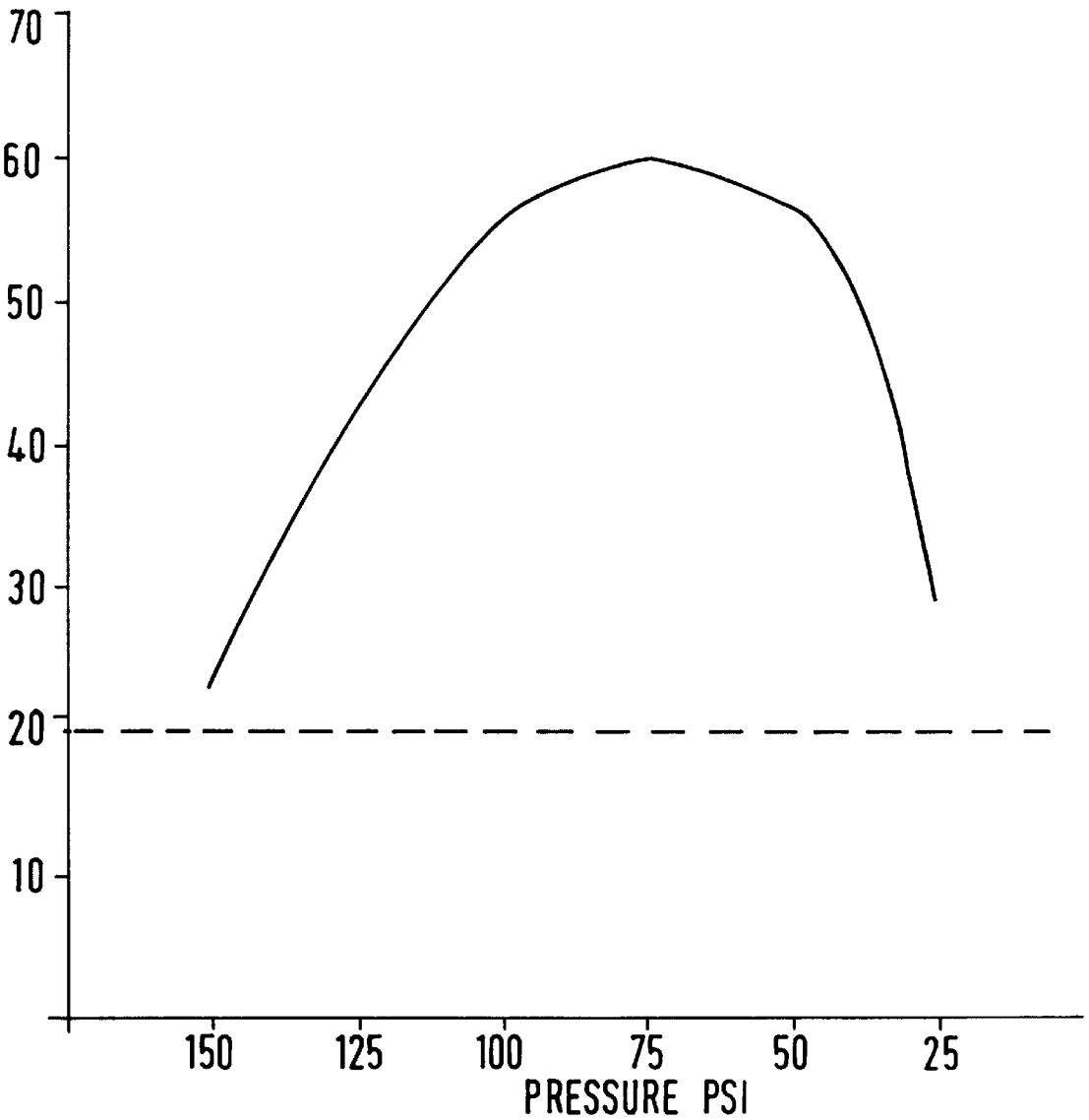
FIG. 3 is a graph showing the relationship between foam concentrate solution supply pressure and expansion rate.

The results are shown graphically in FIG. 3. This test used a nozzle with a flat screen. In general, conical screens produce about 25% higher expansion rate with a similar drop in discharge range.

Test 2

To determine the relationship between area and foam expansion ratios and air intake.

Method:

The nozzle and tank are the same as in Test 1, as is the foam solution type. The tank is pressurized with nitrogen to 75 PSI(0.5 MPa). Also as in Test 1, the foam discharge of the air intakes are increased, 8 in total, as in FIG. 1.

| Results: | | | | | | | | | |
|---|---|---|---|---|---|---|---|---|---|
| AIT Area | | | | | | | | | |
| 6 | 25 | 57 | 100 | 157 | 226 | 308 | 402 | 509 | 628 |
| Expansion | | | | | | | | | |
| 11 | 14 | 24 | 33 | 45 | 50 | 53 | 56 | 64 | 67 |

The air intake area is calculated by:

$$\pi r^2(8) = \text{AIT area}$$

Figure 4:
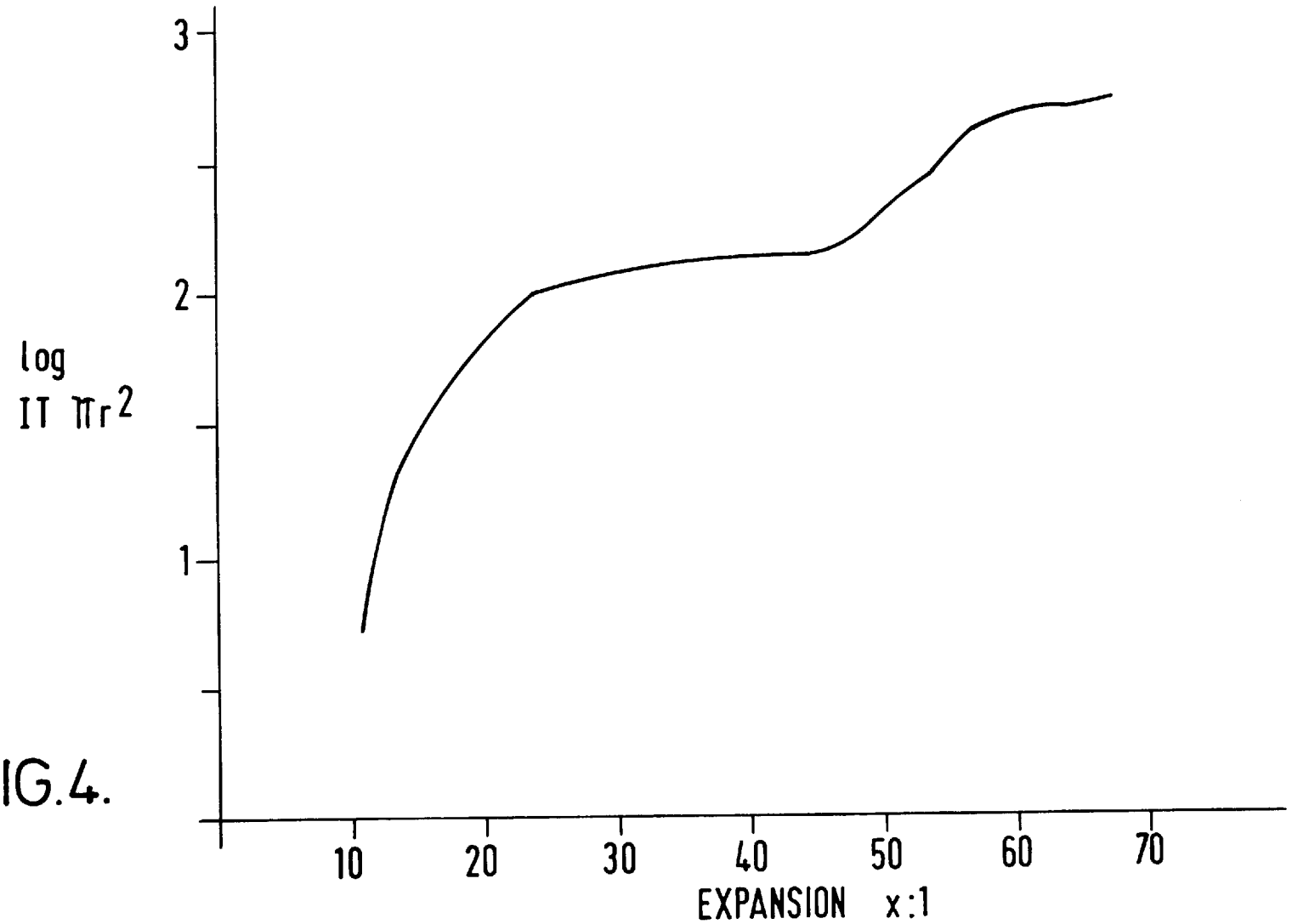
FIG. 4 is a graph showing the relationship between air intake area and foam expansion ratios.

In FIG. 4, AIT area values are given as log:

| | | | | | | | | | |
|---|---|---|---|---|---|---|---|---|---|
| 6 | 25 | 57 | 100 | 157 | 226 | 308 | 402 | 509 | 628 |
| 0.77 | 1.39 | 1.75 | 2. | 2.19 | 2.35 | 2.48 | 2.60 | 2.70 | 2.79 |

(The rather irregular figures are due to violation of vacuum space by larger air intake ports)

Test 3

To determine the expansion ratios of foams formed when using common foam compounds with the nozzle of FIG. 1.

Method:

2 liters of the foam compound solution was placed into a tank and pressurised to 75 PSI (0.5 MPa) with nitrogen. The foam was then discharged as described previously.

| Results: |
|---|
| 6% AFFF (CNF) — Medium Expansion not generated |
| 6% FFFP (CNF) — Expansion 19:1 |

-continued

| Results: |
|---|
| 6% Protein (CNF) — Expansion 36:1 |
| 3% Synthetic (KERR) — Expansion 60:1 |
| 5% AFFF Multi (3M) — Expansion 55:1 |

(CNF — 'Chubb National Foam' Ltd, 3M – '3M UK' Ltd, KERR — 'Croda Kerr' Ltd)

Test 4

To determine the fire fighting capability of the medium expansion foam fire extinguisher charged with 5% AFFF Multi (3M) on a flammable liquid spill fire.

Method:

4×1 $m^2$ steel trays of depth 3 inches were arranged in a square formation. Into each of the four trays, 30 liters of diesel oil was placed thus producing a total of 120 liters fuel fire. The trays were ignited with a gas lance and when full surface fire involvement was evident, the fire was allowed to pre-burn for 60 seconds. A medium expansion foam fire extinguisher containing 5 liters of foam compound solution fitted with the nozzle of FIG. 2 was then discharged onto the burning fuel using no special methods. The fuel used was a linear and branched alkane fuel—FP 72° C., BP 278° C.

Results:

The fire was extinguished and secured uneventfully. The time factors were as follows:

Fire 75% Control Time:6 secs

Fire 90% Control Time:10 secs

Fire Extinguishment Time:20 secs (all determined visually, not by I.R. techniques)

Test 5

To determine the fire fighting capability of the medium expansion foam extinguisher charged with a saponifiable fluorinated foam compound blend, on a 20 liter fat fire.

Method:

20 liters of fat blend used by the fast food chain 'McDonalds' was placed into an electric fry vat with a power rating of 7 Kwh. All of the temperature control circuitry was by-passed. The power was turned on and after about 40 minutes the oil ignited. At this point, the power was kept on for 30 seconds, then turned off. The fat was allowed to pre-burn for 2 minutes. Foam was then applied using no special methods. As in Test 4, the nozzle used was as described in FIG. 2. The foam was applied to the burning fat until the fry vat was overflowing, at which time the discharge was stopped.

Results:

The fire was extinguished uneventfully with no hazardous spitting or boil-over whatsoever. The water content of the foam lowered the temperature of the fat from 370° C. to 280° C. within seconds. There was no mess. Due to the rapid drop in temperature, the fat did not re-ignite upon cessation of discharge and production of toxic pyrolysis products was stopped.

Conclusion on Tests 4& 5

These examples of fire tests carried out show that medium expansion foam from portable fire extinguishers is ideal for use in fire situations involving flammable liquids and oils especially when used by a novice. Very little or no training is required, and once the fire is extinguished, it does not re-ignite, due to the volume of foam blanketing. The extinguisher poses no serious clean-up problems and has potential application in a large variety of risk situations.

Medium expansion foam from extinguishers are also a valuable aid in the mitigation of toxic chemical spills in laboratories and chemical plants, and in securing flammable liquid spills.

While this invention has been described with respect to particular embodiments thereof, it is apparent that numerous other forms and modifications of this invention will be obvious to those skilled in the art. The appended claims and this invention generally should be construed to cover all such obvious; forms and modifications which are within the true spirit and scope of the present information.

We claim:

1. A hand held portable medium expansion foam fire extinguisher having a reservoir for a supply of foam concentrate solution, means for discharging said foam concentrate solution from said reservoir, comprising:

a nozzle arrangement having;

a casing, said casing having a proximal end and a distal end, said casing having a foam discharge port at said distal end;

a foam concentrate solution supply nozzle within said casing, having an outlet for discharging a cone of foam concentrate spray into said casing;

at least one air inlet to said casing;

and a mesh screen, said mesh screen being located within said casing at a position intermediate said supply nozzle and said discharge port;

said at least one air inlet being located along said casing at a position in line with said outlet from said supply nozzle;

wherein said foam concentrate solution is at a pressure in the range of from about 3 to about 15 bar and the foam expansion ratio of said foam in use is in the range of from about 1:20 to about 1:150.

2. The delivery device of claim 1, wherein said discharge means comprises an excess pressure within said reservoir.

3. The delivery device of claim 1, wherein:

said pressure of said foam concentrate solution is in the range of from about 8 to about 12 bar;

said supply nozzle comprises a 90° full cone nozzle;

said mesh screen is a single fine mesh screen; and said discharge port has a diameter of about 2 to about 3 cm.

4. The delivery device of claim 1, wherein:

said pressure of said foam concentrate solution is in the range of from about 4 to about 20 bar;

said supply nozzle is a 30° full cone nozzle;

said screen comprises a flat screen and a coarse mesh conical screen; and said discharge port has a diameter of about 3.5 to about 4 cm.

5. The delivery device of claim 1, wherein:

said pressure of said foam concentrate solution is in the range of from about 4 to about 20 bar;

said supply nozzle is a 30° full cone nozzle;

said screen comprises a flat screen and a coarse mesh conical screen; and said discharge port has a diameter of about 3.5 to about 4 cm.

* * * * *

UNITED STATES PATENT AND TRADEMARK OFFICE

CERTIFICATE OF CORRECTION

PATENT NO. : 5,857,627

DATED : January 12, 1999

INVENTOR(S) : Horwell, et al

It is certified that error appears in the above-indentified patent and that said Letters Patent is hereby corrected as shown below:

On the title page, item [73] Assignee, should read -- Warnstar Limited, Kenley, Surrey CR2 7YS, England --, Signed and Sealed this Twelfth Day of October, 1999

*Attest:*

Q. TODD DICKINSON

*Attesting Officer*

*Acting Commissioner of Patents and Trademarks*